US008955205B2

(12) United States Patent
Beliveau

(10) Patent No.: US 8,955,205 B2
(45) Date of Patent: Feb. 17, 2015

(54) BURIAL CAPSULE

(71) Applicant: Pierre Beliveau, Granby (CA)

(72) Inventor: Pierre Beliveau, Granby (CA)

( * ) Notice: Subject to any disclaimer, the term of this patent is extended or adjusted under 35 U.S.C. 154(b) by 0 days.

(21) Appl. No.: 14/297,184

(22) Filed: Jun. 5, 2014

(65) Prior Publication Data

US 2014/0359983 A1 Dec. 11, 2014

(30) Foreign Application Priority Data

Jun. 7, 2013 (GB) ..... 1310263.7

(51) Int. Cl.
*A61G 17/00* (2006.01)
*A61G 17/007* (2006.01)
*A61G 17/04* (2006.01)

(52) U.S. Cl.
CPC ..... *A61G 17/0076* (2013.01); *A61G 17/00* (2013.01); *A61G 2017/047* (2013.01)
USPC ..... 27/11; 27/2; 27/17; 27/27; 16/424

(58) Field of Classification Search
CPC ..... A61G 17/00; A61G 17/02; A61G 17/04; A61G 2017/00; A61G 2017/04; A61G 2017/041; A61G 2017/044; A61G 2017/047; A61G 2017/048; A47B 95/02
USPC ..... 27/2, 11, 12, 17, 19, 27, 6; 16/424, 425, 16/436, 439
See application file for complete search history.

(56) References Cited

U.S. PATENT DOCUMENTS

| | | | | |
|---|---|---|---|---|
| 167,451 | A | | 9/1875 | Hunt |
| 188,014 | A | | 3/1877 | Holmes |
| 636,603 | A | | 11/1899 | Williams |
| 818,220 | A | | 4/1906 | Belair |
| 842,831 | A | | 1/1907 | Eagelman |
| 915,928 | A | | 3/1909 | Barnes |
| 2,247,617 | A | | 7/1941 | Metz |
| 2,516,488 | A | | 7/1950 | Smith |
| 2,579,756 | A | | 12/1951 | Reed |
| 2,811,768 | A | | 11/1957 | Axelson |
| 2,835,955 | A | | 5/1958 | Snyder |
| 2,882,584 | A | | 4/1959 | Kidd |
| 3,164,880 | A | | 1/1965 | Hotchkiss |
| 3,435,494 | A | | 4/1969 | Bernard |
| 3,716,072 | A | * | 2/1973 | Criswell ..... 137/510 |
| 3,878,657 | A | | 4/1975 | Ferver |
| 3,924,309 | A | | 12/1975 | Andrus, Jr. et al. |
| 3,964,140 | A | | 6/1976 | Gauchard |
| 4,253,220 | A | | 3/1981 | Work |
| 4,404,716 | A | | 9/1983 | Foust |
| 4,523,358 | A | | 6/1985 | Semon |
| D292,635 | S | | 11/1987 | McCormack et al. |
| 4,924,565 | A | | 5/1990 | Rathjen |
| 4,949,439 | A | | 8/1990 | Semon |

(Continued)

*Primary Examiner* — William Miller

(57) ABSTRACT

A burial capsule usable with an inert gas for replacing air in the burial capsule, the burial capsule comprising a sealable shell defining a chamber therein and a shell outer surface, the shell defining a shell inlet and a shell outlet both extending therethrough between the shell outer surface and the chamber for respectively receiving the inert gas and releasing the air contained in the chamber to allow replacement of the air by the inert gas when the inert gas flows in the chamber through the shell inlet. The burial capsule also includes a first valve handle anchor mountable to the shell and a first handle mountable the first valve handle anchor. The first valve handle anchor acts as a valve to selectively alternatively allow and prevent flow of the inert gas in the chamber through the shell inlet.

16 Claims, 5 Drawing Sheets

(56) References Cited

U.S. PATENT DOCUMENTS

| | | | | |
|---|---|---|---|---|
| 4,951,367 | A | 8/1990 | Wolfe | |
| 5,092,020 | A | 3/1992 | MaGuire | |
| 5,135,792 | A | 8/1992 | Hogan | |
| 5,231,741 | A | 8/1993 | MaGuire | |
| 5,245,733 | A | 9/1993 | Goria | |
| RE34,846 | E | 2/1995 | McGuire | |
| 5,444,900 | A | 8/1995 | Shawhan et al. | |
| 5,568,677 | A | 10/1996 | Tobin | |
| 5,615,464 | A | 4/1997 | Rojdev | |
| 5,659,932 | A | 8/1997 | Wright | |
| 5,722,133 | A | 3/1998 | Farris et al. | |
| 5,926,929 | A * | 7/1999 | MacKirdy | 27/2 |
| 6,269,526 | B1 | 8/2001 | Bischoff et al. | |
| D528,733 | S | 9/2006 | Spiegel | |
| 7,204,003 | B2 | 4/2007 | Davis et al. | |
| 7,322,079 | B2 | 1/2008 | Davis et al. | |
| 7,350,278 | B2 | 4/2008 | Davis et al. | |
| D583,125 | S | 12/2008 | Hubbard | |
| 7,703,186 | B1 * | 4/2010 | Williamson | 27/2 |
| D617,075 | S | 6/2010 | Hubbard | |
| 8,104,152 | B2 | 1/2012 | Spiers | |
| D663,915 | S | 7/2012 | Skov | |
| 8,240,013 | B2 * | 8/2012 | Williamson | 27/2 |
| 2005/0028333 | A1 * | 2/2005 | Vosahlik et al. | 27/14 |
| 2005/0050700 | A1 | 3/2005 | Davis et al. | |
| 2007/0091871 | A1 | 4/2007 | Taha | |
| 2010/0186207 | A1 * | 7/2010 | Moore et al. | 27/1 |
| 2011/0030181 | A1 * | 2/2011 | Williamson | 27/14 |
| 2013/0067705 | A1 * | 3/2013 | Williamson | 27/14 |

* cited by examiner

BURIAL CAPSULE

FIELD OF THE INVENTION

The present invention relates generally to burial coffins and, more particularly, to a sealable burial capsule usable for preserving a deceased human or animal under inert gas conditions.

BACKGROUND

Burial capsules usable for preserving a deceased human or animal under inert gas conditions are known. Such burial capsules typically include a base container generally sized and configured for receiving the human or animal corpse laying horizontally therein, and a sealing cover adapted for hermetically closing the open end of the base container using typically a plurality of threaded screw and hole combinations disposed along overlapping circumferential edge portions of the container and cover.

Known burial capsules further typically include an inlet and an outlet valve means that are in fluid communication with the interior of the burial capsule. These valve means are usable for injecting an inert gas, such as Argon or other equivalent inert gas, through the inlet valve which, in turn, purges any residual air out of the sealed capsule through the outlet valve.

In some instances, these burial capsules are also typically provided with side handles disposed along longitudinal side portions thereof for handling the capsule during funeral ceremonies, storage or burial purposes.

While these known burial capsules can generally fulfill the main objective of providing a sealable burial capsule for preserving a human corpse under inert gas conditions, the visual presence of, for example, screw heads of screws used to engage the cover with the base container, additionally to the inlet and outlet valves means, generally renders the burial capsule a commercially less appealing burial product, as well as provoking visual distractions to the generally solemn ceremonies that usually involve the visual display of such products.

Furthermore, although a sealable burial capsule may be buried in the ground of a cemetery in a conventional manner, some are stored in above ground mausoleums having rack-mount style facilities. Most sealable burial capsules don't have handling elements that can substantially facilitate transport and handling of the capsule through such storage facilities.

Furthermore, most known burial capsules fail to provide an efficient collection and neutralization of the body fluids that eventually accumulate at the bottom of their base container.

Against this background, there exists a need for an improved sealable burial capsule. An object of the present invention is to provide such a capsule.

SUMMARY OF THE INVENTION

In a broad aspect the invention provides a burial capsule usable with an inert gas for replacing air in the burial capsule, the burial capsule comprising: a sealable shell defining a chamber therein and a shell outer surface, the shell defining a shell inlet and a shell outlet both extending therethrough between the shell outer surface and the chamber for respectively receiving the inert gas and releasing the air contained in the chamber to allow replacement of the air by the inert gas when the inert gas flows in the chamber through the shell inlet; a first valve handle anchor mountable to the shell; and a first handle mountable the first valve handle anchor. The first valve handle anchor defines a first anchor inlet, a first anchor outlet and a first anchor passageway extending therebetween, the first valve handle anchor being configurable between a first anchor open configuration and a first anchor closed configuration. In the first anchor open configuration, the first anchor outlet is in a fluid communication relationship with the shell inlet and flow of the inert gas through the first anchor passageway from the first anchor inlet to the first anchor outlet is allowed, and, in the first anchor closed configuration, flow of the inert gas between the first anchor inlet and the shell inlet is prevented.

In some embodiments of the invention, the shell includes a shell first portion and a shell second portion, the shell first and second portions being joined to each other by a shell first portion-to-shell second portion joint.

In some embodiments of the invention, the first valve handle anchor is removably mountable to the shell. For example, the first valve handle anchor is removably mountable to the shell at the shell first portion-to-shell second portion joint so that when the first valve handle anchor is mounted to the shell, the first valve handle anchor engages both the shell first and second portions to lock the shell first and second portions to each other.

In some embodiments of the invention, the shell first portion-to-shell second portion joint is a tongue and groove joint, the shell inlet extends through the tongue and groove joint and the first valve handle anchor is mountable to the shell inlet.

In some embodiments of the invention, a second valve handle anchor is removably mountable to the shell, the shell outlet extends through the tongue and groove joint and the second valve handle anchor is mountable to the shell outlet. For example, the second valve handle anchor defines a second anchor inlet, a second anchor outlet and a second anchor passageway extending therebetween, the second valve handle anchor being configurable between a second anchor open configuration and a second anchor closed configuration, wherein, in the second anchor open configuration, the second anchor inlet is in a fluid communication relationship with the shell outlet and flow of the air through the second anchor passageway from the second anchor inlet to the second anchor outlet is allowed, and, in the second anchor closed configuration, flow of the air between the shell outlet and the second anchor outlet is prevented.

In a variant, the shell inlet is delimited by an inlet peripheral surface extending between the shell outer surface and the chamber, the first valve handle anchor and the inlet peripheral surface being configured and sized so that in the first anchor closed configuration, the first anchor outlet abuts against the inlet peripheral surface, and in the first anchor open configuration, the first valve handle anchor is partially inserted in the shell inlet so that the first anchor outlet is spaced apart from the inlet peripheral surface to allow flow of the inert gas out from the first anchor outlet into the shell inlet.

In another variant, the first valve handle anchor includes a valve operatively coupled to the first anchor passageway so that the valve is configurable between a valve open configuration and a valve closed configuration respectively allowing and preventing flow of the inert gas through the first anchor passageway, the valve being in the valve open and closed configurations when the first valve handle anchor is respectively in the first anchor open and closed configurations.

In some embodiments of the invention, the first valve handle anchor is substantially elongated, and the first anchor passageway extends substantially longitudinally through the first valve handle anchor.

In some embodiments of the invention, the shell defines a fluid collecting basin, and the burial capsule further comprises a substantially rigid and fluid permeable body support substantially adjacent the fluid collecting basin. For example, the body support is selected from the group consisting of a perforated metal sheet and a metal screen filter.

In some embodiments of the invention, cat litter is provided in the fluid collecting basin.

In some embodiments of the invention, at least one wheel protrudes from the shell. For example, the wheel is a spherical wheel partially contained in the shell.

In some embodiments of the invention, the first anchor inlet and outlet are hidden from view respectively by the first handle and the shell when the first valve handle anchor is mounted to the shell and the first handle is mounted to the first valve handle anchor.

The present invention provides an improved sealable burial capsule for preserving a deceased human or animal under inert gas conditions. Thus, with the shell first and second portions hermetically attached to each other using the valve handle anchors engaged in respective shell inlet and outlets and with both valves in an open configuration, a neutral gas such as Argon may be injected through one of the anchor passageways until substantially all of the atmospheric air is expelled from the interior of the burial capsule. Subsequently, both valves may be closed and the pair of handles mounted to the handle anchors on each sides of the burial capsule, for providing a sealable burial capsule that preserves a human body in a neutral gas environment.

A burial capsule of the present invention may be advantageously produced having relatively high aesthetical characteristics of shape, design and color. Also, when present, the wheels facilitate handling of the burial capsule when used in a mausoleum.

Other objects, advantages and features of the present invention will become more apparent upon reading of the following non-restrictive description of some embodiments thereof, given by way of example only with reference to the accompanying drawings.

DETAILED DESCRIPTION

In a broad aspect, the present invention relates to a sealable burial capsule 10 for preserving a deceased human or animal under inert gas conditions. To that effect, the burial capsule 10 is configured for allowing inert gas to replace air in the burial capsule 10. FIGS. 1, 2 and 4 to 7 inclusively show various aspects of an embodiment of the burial capsule 10 according to the present invention.

The term "substantially" is used throughout this document to indicate variations in the thus qualifies terms. These variations are variations that do not materially affect the manner in which the invention works and can be due, for example, to uncertainty in manufacturing processes or to small deviations from a nominal value that do not cause significant changes to the invention. These variations are to be interpreted from the point of view of the person skilled in the art. Also, directional terminology such as top, bottom and horizontal, among others, is used in this document and refer to the burial capsule 10 in a typical operational configuration. This terminology is used for clarity reasons and should not be used to restrict the scope of the appended claims unless explicitly mentioned in the claims.

Figure 1:
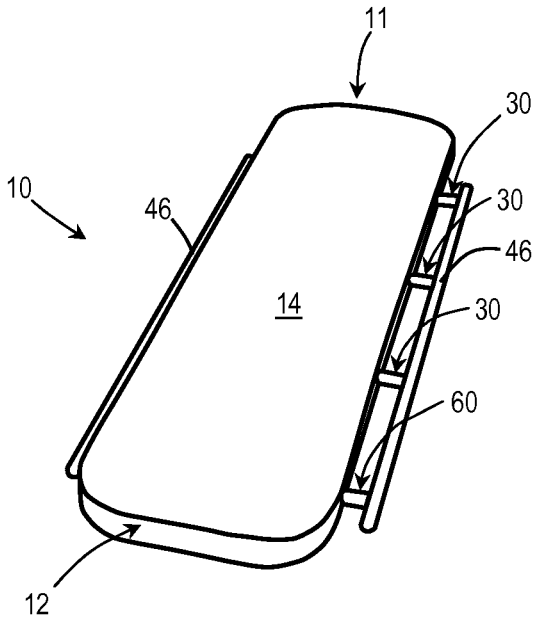
FIG. 1, in a perspective view, illustrates a burial capsule in accordance to an embodiment of the present invention.
Figure 2:
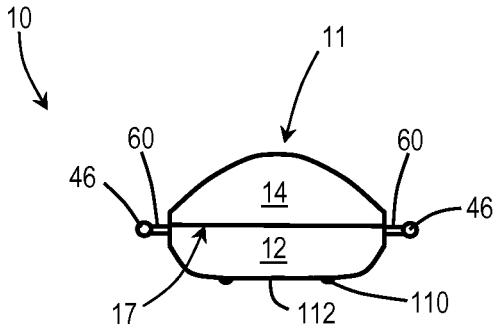
FIG. 2, in a front elevational view, illustrates the burial capsule of FIG. 1.

Referring for example to FIG. 1, the burial capsule 10 generally includes a sealable shell 11, handle anchors 30 and valve handle anchors 60 mountable to the shell 11 and at least one, and typically two elongated handles 46 mountable to the handle anchors 30 and valve handle anchors 60. The differences between the handle anchors 30 and valve handle anchors 60 are detailed hereinbelow.

The shell 11 is typically substantially elongated with two series of mixed handle anchors 30 and valve handle anchors 60 positioned at longitudinally spaced apart positions thereabong on opposite sides of the shell 11. Typically, the handle anchors 30 and valve handle anchors 60 are removably mountable to the shell 11. The handles 46 are each mounted to a respective series of mixed handle anchors 30 and valve handle anchors 60. It should be noted that the present invention is usable with burial capsules 10 having alternative configurations. For example, instead of two long handles 46 provided along the shell 11, individual smaller handles (not shown in the drawings), could be mounted each to a respective handle anchor 30 or valve handle anchor 60.

Figure 5:
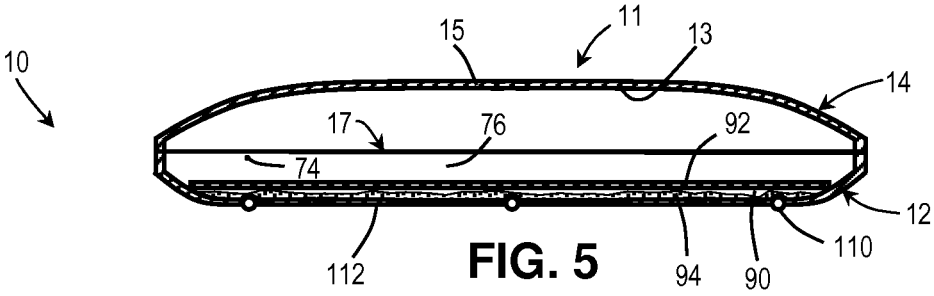
FIG. 5, in a side cross-sectional view, illustrates the burial capsule of FIGS. 1, 2 and 4.
Figure 6:
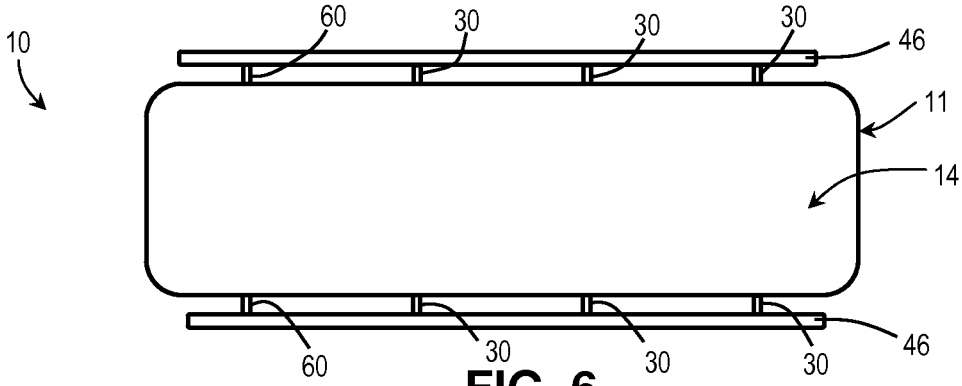
FIG. 6, in a top plan view, illustrates the burial capsule of FIGS. 1, 2, 4 and 5.
Figure 7:
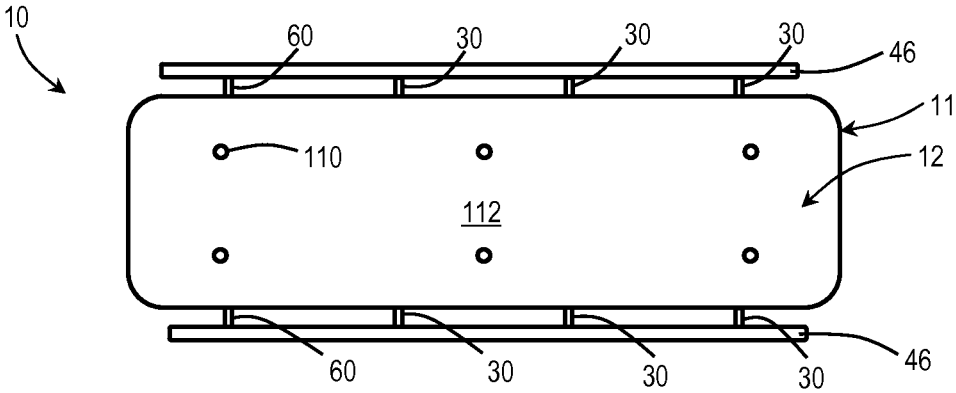
FIG. 7, in a bottom plan view, illustrates the burial capsule of FIGS. 1, 2 and 4 to 6.

As seen for example in FIG. 5, the shell 11 defines a chamber 13 therein and a shell outer surface 15. In a typical embodiment, the shell 11 includes a shell first portion 12 and a shell second portion 14, the shell first and second portions 12 and 14 being joined to each other by a shell first portion-to-shell second portion joint 17. The shell first portion 12 is generally sized and configured for receiving the body of a human corpse, or an other animal, laying longitudinally therein, and the shell second portion 14 is sized and shaped for hermetically closing the shell first portion 12.

Figure 10:
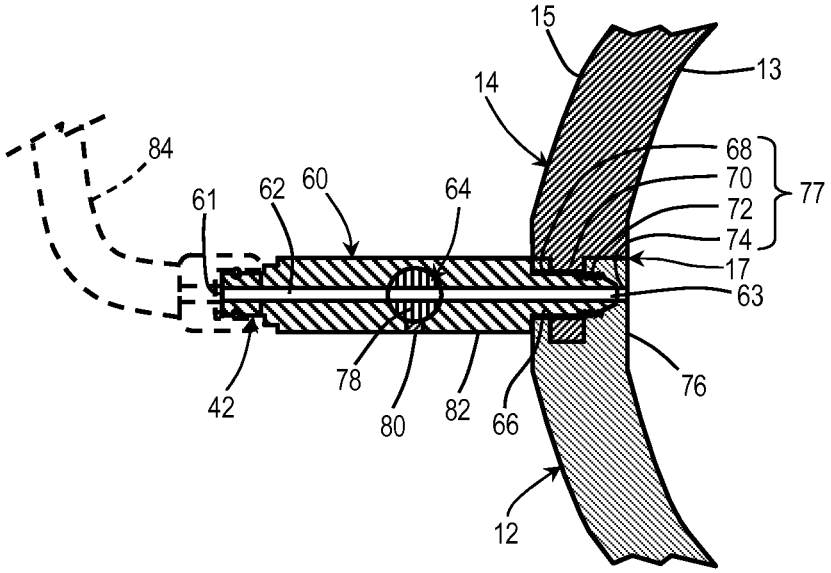
FIG. 10, in a partial cross-sectional view, illustrates the burial capsule of FIGS. 1, 2 and 4 to 9 with a valve part of a valve handle anchor thereof in a valve open configuration and an inert gas source removably attached to the valve handle anchor at an end thereof.

As better seen in FIG. 10, the shell 11 defines a shell inlet 77 and a shell outlet both extending therethrough between the shell outer surface 15 and the chamber 13. The shell outlet is not visible in FIG. 10, but it has the same configuration as the shell inlet 77. The shell inlet 77 and the shell outlet are for respectively receiving the inert gas and releasing the air contained in the chamber 13 to allow replacement of the air by the inert gas when the inert gas flows in the chamber 13 through the shell inlet 77.

Figure 11:
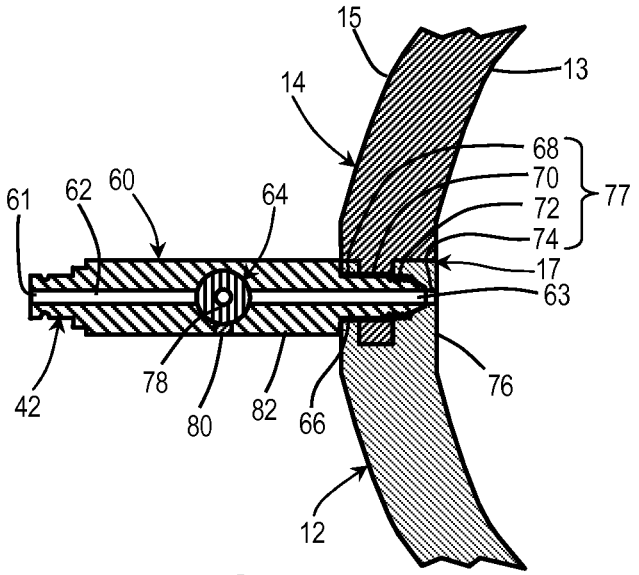
FIG. 11, in a partial cross-sectional view, illustrates the burial capsule of FIGS. 1, 2 and 4 to 10, here shown with the valve in a valve closed configuration and the inert gas source detached from the valve handle anchor.

One of the valve handle anchors 60 is a first valve anchor handle 60, better seen in FIGS. 10 and 11. The first valve handle anchor 60 defines a first anchor inlet 61, a first anchor outlet 63 and a first anchor passageway 62 extending therebetween. The first valve handle anchor 60 is configurable between a first anchor open configuration, seen in FIG. 10, and a first anchor closed configuration, seen in FIG. 11. In the first anchor open configuration, the first anchor outlet 63 is in a fluid communication relationship with the shell inlet 77 and flow of the inert gas through the first anchor passageway 62 from the first anchor inlet 61 to the first anchor outlet 63 is allowed. In the first anchor closed configuration, flow of the inert gas between the first anchor inlet 61 and the shell inlet 77 is prevented. A second valve handle anchor 60 having a similar structure is provided in some embodiments, with the difference that the second valve handle anchor 60 serves as an outlet, and therefore allows flow of gases, such as air, therethrough in the opposite direction. In some embodiments of the invention, the first anchor inlet and outlet 61 and 63 are hidden from view respectively by one of the handles 46 and the shell 11 when the first valve handle anchor 60 is mounted to the shell 11 and the first handle 46 is mounted to the first valve handle anchor 60.

Figure 8:
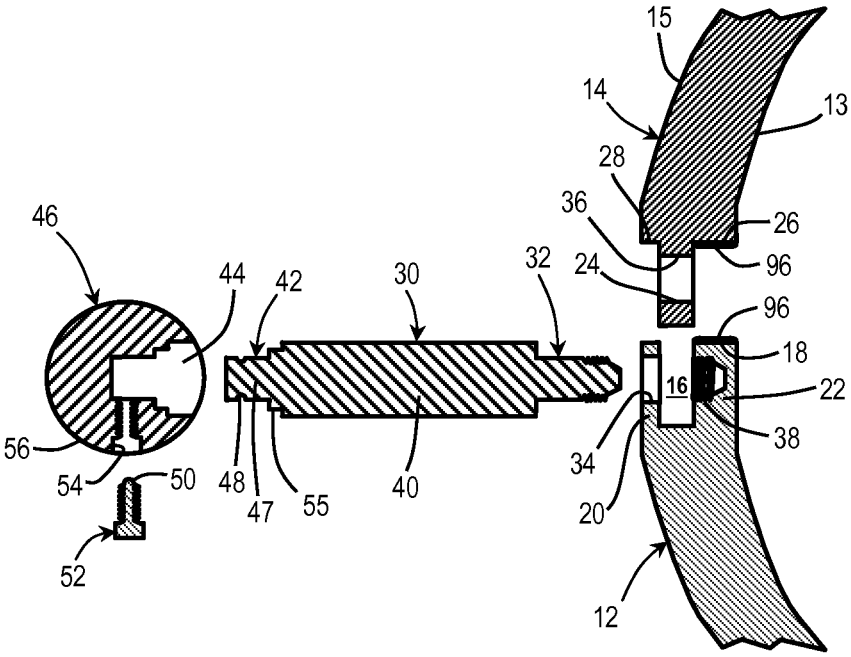
FIG. 8, in an exploded, partial cross-sectional view, illustrates the burial capsule of FIGS. 1, 2 and 4 to 7.
Figure 9:
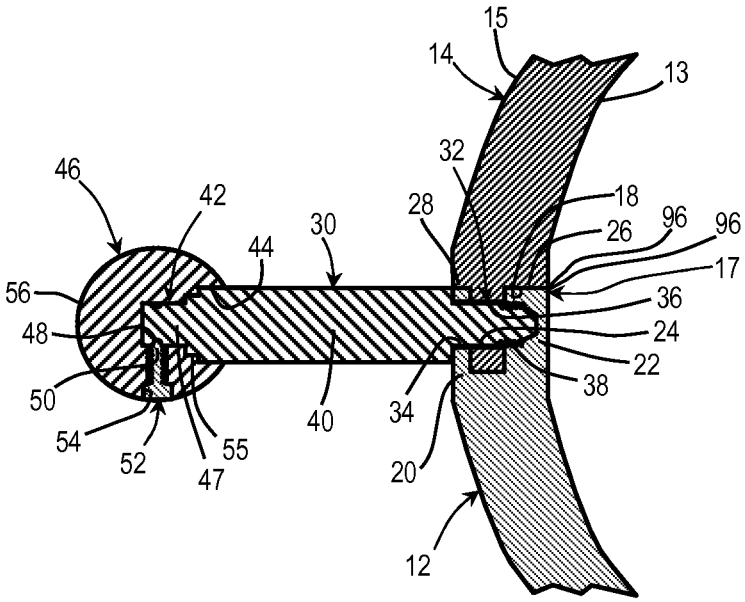
FIG. 9, in a partial cross-sectional view, illustrates the burial capsule of FIGS. 1, 2 and 4 to 8.

Now referring more particularly to FIGS. 8 and 9, typically, the shell first portion 12 forms a base and the shell second portion 14 form a cover, each making about half of the shell 11 and delimiting a respective aperture. In the specific embodiment of the invention shown in the drawings, the shell first portion-to-shell second portion joint 17 is a tongue and groove joint. Typically, the shell inlet 77 and shell outlet take the form of inlet and outlet apertures extending through this tongue and groove joint. The first and second valve handle anchors 60 are mountable respectively in the shell inlet 77 and shell outlet, as seen in FIGS. 10 and 11 for the shell inlet 77.

Referring to FIG. 8, more specifically, the shell first portion 12 defines a cover edge receiving groove 16 extending along the whole circumference of the aperture thereof. The cover edge receiving groove 16 extends substantially perpendicularly inwardly and vertically downwardly relative to a container edge top surface 18. Thus, the shell first portion 12 further defines a pair of parallelly disposed and substantially upwardly extending container peripheral outer edge 20 and container peripheral inner edge 22 respectively, on each side of the cover edge receiving groove 16.

In turn, the shell second portion 14 defines cover lip inner and outer shoulders 26 and 28 and a cover edge engaging lip 24 provided therebetween, that are extending along the whole circumference of the aperture thereof.

The cover edge engaging lip 24 and the pair of corresponding cover lip inner and outer shoulders 26 and 28 are shaped and sized to freely engage in a preferably snug fit relation the cover edge receiving groove 16, and upper edge portions of the container peripheral outer edge 20 and container peripheral inner edge 22 respectively.

Figure 3:
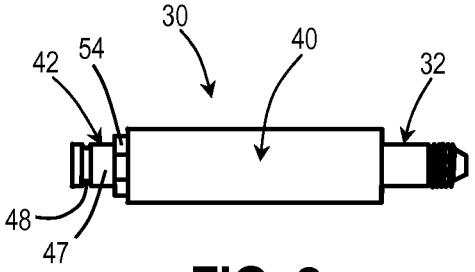
FIG. 3, in a side elevational view, illustrates a handle anchor part of the burial capsule shown in FIGS. 1 and 2.
Figure 4:
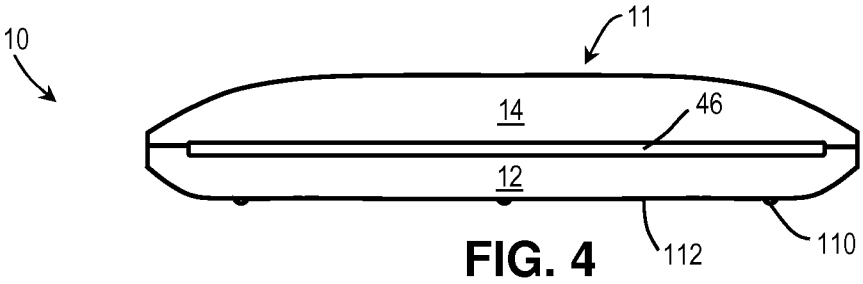
FIG. 4, in a side elevational view, illustrates the burial capsule of FIGS. 1 and 2.

Now referring more particularly to FIGS. 3, 8 and 9, each handle anchor 30 is typically substantially elongated and defines an anchor threaded screw end 32 that is sized and shaped for simultaneously freely engaging a pair of correspondingly aligned holes and threaded bore combination that is extending laterally inwardly through overlapping edge portions of the shell first and second portions 12 and 14, as seen in FIGS. 8 and 9. Namely, a container outer edge hole 34, a cover edge hole 36 and a container inner edge threaded bore 38 extend respectively laterally inwardly through corresponding portions of the container peripheral outer edge 20 and the cover edge engaging lip 24, and partially laterally inwardly through the container peripheral inner edge 22.

Each handle anchor 30 further defines an elongated anchor main body portion 40 and an anchor distal end portion 42. The anchor distal end portion 42 is sized and shaped for engaging in a snug fit relation a compatibly shaped handle bore 44 extending substantially laterally inwardly along a common longitudinal side portion of an elongated handle 46.

As best illustrated in FIGS. 3 and 8, anchor distal end portion 42 defines a cylindrical handle engaging member 47 extending preferably axially distally relative to the anchor main body portion 40. For example, cylindrical handle engaging member 47 may have a diameter that is equal to but typically relatively smaller than the diameter of the anchor main body portion 40.

Furthermore, cylindrical handle engaging member 47 is typically provided with an engaging member circumferential groove 48 proximal a distal end thereof for engaging a locking screw distal end 50 of a locking screw 52, as best illustrated in FIGS. 8 and 9. Locking screw 52 is engaged through a locking screw threaded hole 54 extending laterally inwardly through preferably an underside portion 56 of the handle 46.

The anchor distal end portion 42 further defines an intermediate tool engaging portion 55 disposed for example at the junction between the cylindrical handle engaging member 47 and the anchor main body portion 40. Intermediate tool engaging portion 55 is suitably shaped and configured for engaging a manual or power tool (not shown in the drawings) usable for screwing and firmly tightening in place the anchor threaded screw end 32 of the handle anchor 30 through the correspondingly aligned holes and threaded bore combination 34, 36 and 38 respectively.

For example, the intermediate tool engaging portion 55 may be represented by a conventional hexagonal configuration suitably sized and shaped for being engaged by any compatible open wrench, box wrench, a hexagonal socket for a ratchet wrench, or the likes.

Typically, the burial capsule 10 is provided with four (4) handle anchors 30 having their anchor threaded screw end 32 engageable in a corresponding number of aligned holes and corresponding number of threaded bore combinations 34, 36 and 38, and their anchor distal end portion 42 engageable in a corresponding number of handle bores 44 provided along the handles 46. Other numbers of handle anchors 30 and corresponding aligned holes and corresponding number of threaded bore combinations 34, 36 and 38 and handle bores 44 are also possible. Furthermore, the handle anchors 30 and associated elements described above are typically distributed evenly in a spaced apart relation on each side of the burial capsule 10, in combination with the valve handle anchors 60.

Now referring more particularly to FIGS. 10 and 11, the burial capsule 10 further includes at least one valve handle anchor 60, and typically at least two valve handle anchors 60. Each valve handle anchor 60 is removably mountable to the shell 11 at the shell first portion-to-shell second portion joint 17 so that when the valve handle anchors 60 are mounted to the shell 11, the valve handle anchors 60 engage both the shell first and second portions 12 and 14 to lock the shell first and second portions 12 and 14 to each other, along with the handle anchors 30.

Each valve handle anchor 60 is substantially similar to the handle anchor 30 described above except that it further includes an anchor passageway 62 extending longitudinally therethrough between the anchor distal end portion 42 and an anchor threaded end 66. The valve handle anchors 60 include a valve 64 operatively coupled to the anchor passageway 62 so that the valve 64 is configurable between a valve open configuration, as seen in FIG. 10, and a valve closed configuration, as seen in FIG. 11, respectively allowing and preventing flow of the inert gas through the anchor passageway 62. The valve 64 is in the valve open and closed configurations when the valve handle anchor 60 is respectively in the anchor open and closed configurations.

Each valve handle anchor 60 defines an anchor threaded end 66 engageable in a corresponding number of valve through holes and threaded bores combinations 68, 70 and 72 respectively. Each valve through holes and threaded bore combination 68, 70 and 72 is substantially similar to the through holes and threaded bore combinations 34, 36 and 38 described further above except that the container inner edge threaded bore 72 further includes a passageway extension 74 extending therefrom to an inner surface portion 76 of the burial capsule 10, in the chamber 13, as best illustrated in FIGS. 5, 10 and 11. The valve through holes and threaded bores combinations 68, 70 and 72, along with the passageway extension 74, define the shell inlet 77 and shell outlet.

The valve 64 may be any suitable valve of the prior art that is selectively operable between valve open and closed configurations. For example, the valve 64 may be represented by a conventional ball valve 78 having its rotatable control member 80 preferably discreetly accessible through an underside portion 82 of the valve handle anchor 60. The ball valve 78 is operable between valve open and closed configurations, as illustrated in FIGS. 10 and 11 respectively.

Thus, with each of the at least two (2) valve handle anchors 60 engaged in a corresponding valve through holes and threaded bores combination 68, 70 and 72, an inert gas source 84 fluidly coupled to one of the anchor distal end portions 42, and all the valves 64 in a valve open configuration, as illustrated in FIG. 10, an inert gas may be injected through the first valve handle anchor 60. This action forces any atmospheric air out of the burial capsule 10 through the second valve handle anchor 60. Once all the atmospheric air in the burial capsule 10 has been replaced with the inert gas, all the valves 64 may be closed and the inert gas source 84 removed from the valve handle anchors 60. It should be noted that in some embodiments of the invention, only one valve handle anchor 60 is used and that evacuation of air is simply made through the shell outlet. Then, when sealing of the shell is desired, a handle anchor 30 is screwed in the shell outlet and the valve 64 of the shell inlet is moved to the valve closed configuration.

It is to be understood that other conventional valves 64 than the ball valve 78 exemplified in the drawings could be used. For example, a conventional tire valve (not shown in the drawings) could be used. Thus, a tire valve may be longitudinally engaged in a threaded bore extending longitudinally inwardly relative to the anchor distal end portion 42 of the valve handle anchor 60. With this particular type of valve, a first valve is used to fill the burial capsule 10 with an inert gas, while the other tire valve is temporarily removed to allow the atmospheric air to be purged from the capsule.

A contemplated type of such tire valve may be, for example, a tire valve commonly referred to in the industry as the "chromed mag wheel valve". This type of valve is typically used on high performance mag wheel tires. It has a sturdy design offering significantly higher long term reliability compared to standard type valve since it is made of chromed parts with typically doubled seal O-rings. This type of tire valve is typically provided with a low profile sealing cap to further secure the sealing capabilities of the valve.

With reference to FIG. 5, the shell 11 further typically defines a fluid collecting basin 90, for example integrally formed along an inner bottom portion of the shell first portion 12, for collecting body fluids therein. The fluid collecting basin 90 is covered with a substantially rigid and fluid permeable body support 92 for supporting a body provided substantially adjacent the fluid collecting basin 90. For example, the body support 92 may be represented by a perforated metal sheet, a metal screen filter, or the likes. Furthermore, the fluid collecting basin 90 may preferably provided with a sufficient quantity of a commercially available cat litter 94, for efficiently absorbing and neutralizing the fluids collected therein. Cat litter 94 has been found as being among the most efficient materials there is for this purpose. For example, selected brands of commercially available cat litter may absorb and retain in agglomerated clumps up to forty times their own weight in fluid. An example of cat litter that has been found to work well for the present application is wood based cat litter, such as the pine pellets cat litter commercialized under the name "Feline Fresh"™ but other substances are usable also. For example, and non-limitingly, silica gel would also be suitable.

As illustrated in FIGS. 2, 4, 5 and 7, the burial capsule 10 further typically includes a plurality of wheels 110 protruding from the shell 11. Each wheel 110 is for example a spherical wheel partially contained in the shell 11, for example rotatably mounted in suitably shaped roller ball wheel cavities extending inwardly in an equidistantly spaced apart relation along the bottom surface 112 of the shell first portion 12, for facilitating the transport and handling of the burial capsule 10.

Typically, the shell first portion 12, permeable sheet 92, handle anchors 30, valve handle anchors 60 and handles 46 are made of stainless steel, while the shell second portion 14 is made of aluminum or stainless steel. It is to be understood that other sufficiently rigid, non-biodegradable and corrosion-proof material, or combinations thereof, are also possible such as, for example, glass, copper, brass, a suitable nickel alloy, plastic such as for example polystyrene, fiberglass, carbon fiber composites, transparent Pyrex™ and the likes.

As illustrated in FIG. 8, a sealing material 96 is typically used to provide permanent seal properties between the shell first and second portions 12 and 14. For example, the sealing material 96 may be represented by a silicone based sealant applied with a conventional caulking gun, a preformed gasket made of a suitable resilient material such as a synthetic rubber, or a combination thereof. Prior to closing the shell first portion 12 with the shell second portion 14, the sealing material 96 may be applied along oppositely facing circumferential portions of the container peripheral inner edge 22 and the cover lip inner shoulder 26.

Alternatively or concurrently with the sealed portions described above, it is to be understood that a sealing material 96 may be applied along other oppositely facing portions of the corresponding circumferential edges of the shell first and second portion 12 and 14 such as, for example, along inner wall portions of the cover edge receiving groove 16 and/or outer wall portions of the cover edge engaging lip 24.

Typically, silicon or an equivalent sealant, or a conventional Teflon® sealing tape commonly used to seal threaded plumbing components, is applied to the corresponding threaded parts of the valve handle anchors 60 and/or threaded bores 72 of the shell first portion 12, to provide permanent seal qualities therebetween.

Alternatively or concurrently with the sealed threaded parts, a seal O-ring (not shown in the drawings) having a suitable size and configuration, may be suitably positioned between the distal end of the anchor threaded screw end 32 and an innermost portion of the threaded bore 72.

An exemplary method of closing the burial capsule 10 and replacing its inner air with an inert gas will now be described. In a first step, the sealing material 96 is applied along oppositely facing circumferential portions of the container peripheral inner edge 22 and the cover lip inner shoulder 26. In a second step, the cover edge engaging lip 24 of the shell second portion 14 is firmly engaged in the cover edge receiving groove 16 of the shell first portion 12, thus essentially closing the burial capsule 10. In a third step, each handle anchor 30 has its anchor threaded screw end 32 threadedly engaged in a corresponding through holes and threaded bore combination 34, 36 and 38 respectively.

In a fourth step, in a similar manner as in the previous step, each valve handle anchor 60 has its anchor threaded end 66 threadedly engaged in a corresponding valve through holes and threaded bore combination 68, 70 and 72. In a fifth step, with the valves 64 of all the valve handle anchors 60 in a valve open configuration, as illustrated in FIG. 10, a source of inert gas 84 such as Argon is fluidly coupled to a first valve anchor distal end portion 42, followed with injecting the inert gas through the anchor passageway 62, the passageway extension 74 and into the burial capsule 10 until substantially all of the atmospheric air is expelled from therein through the second valve handle anchor 60.

In a sixth step, all valves 64 are closed, the inert gas source 84 removed, and the pair of handles 46 have their handle bores 44 firmly engaged on the anchor distal end portion 42 of the handle anchors 30 and valve handle anchors 60 on each side of the burial capsule 10, using handle locking screws 52.

Thus, there has been described a burial capsule 10 and a method of using same that can be used for preserving a deceased human body in an inert gas environment for a substantially prolonged length of time.

Furthermore, there has been described a burial capsule 10 for preserving a deceased human body in an inert gas environment that conveniently and discreetly hide its technology such as attachment screws or valves means used for hermetically closing the capsule and replacing its inner atmospheric air by an inert gas, thus rendering the burial capsule 10 a more commercially appealing burial product than similar burial capsules of the prior art.

As can be obvious to those skilled in the art, alternate embodiments of a burial capsule are possible without departing from the scope of the present invention.

For example, in some embodiments of the present invention, the mutually corresponding groove and lip configuration of the shell first and second portions 12 and 14, as described further above, can be inverted between the corresponding circumferential edges thereof without departing from the scope of the present invention. In other words, the shell first portion 12 is provided with an engaging lip and, inversely, the shell second portion 14 is provided with an engaging groove.

Furthermore, in some embodiments of the present invention, the container peripheral outer edge 20 can be omitted from the peripheral edge configuration of the shell first portion 12 without affecting the sealable quality shell first portion-to-shell second portion joint 17.

Figure 12:
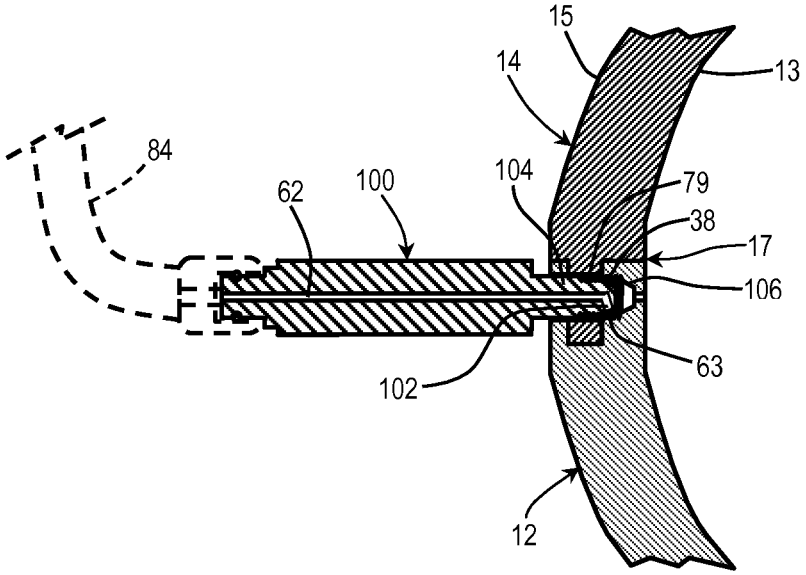
FIG. 12, in a partial cross-sectional view, illustrates an alternate embodiment of burial capsule including an alternate valve handle anchor, the valve handle anchor being shown in an anchor open configuration with an inert gas source removably attached to the handle anchor at an end thereof.
Figure 13:
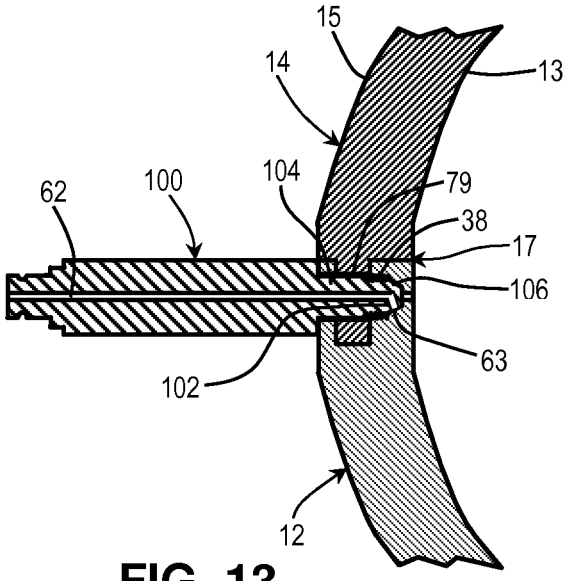
FIG. 13, in a partial cross-sectional view, illustrates the burial capsule of FIG. 12, here shown with the valve handle anchor in an anchor closed configuration and the inert gas source detached from the handle anchor.

Furthermore, in some embodiments, as illustrated in FIGS. 12 and 13, the valve 64 may be replaced by an alternate embodiment of a valve handle anchor 100. The alternate valve handle anchor 100 is substantially similar to the valve handle anchor 60 of the previously described embodiment of a burial capsule 10, except that the ball valve 78 is simply replaced with an end portion 102 of the anchor passageway 62 adjacent the anchor outlet 63 that is oriented substantially sideways at an angle relative to the longitudinal axis of the valve handle anchor 60. Furthermore, the end of the valve anchor threaded end 104 has preferably a substantially tapered configuration in register with a compatibly shaped threaded bore inner end 106.

Thus, alternate valve handle anchor 100 is operable between anchor open and closed configurations in a substantially similar manner as a fluid brake purging plug typically found on hydraulic brake systems installed on vehicles. The alternate valve handle anchor 100 is thus in an anchor open configuration when it is not fully threadedly engaged in the container inner edge threaded bore 38, as illustrated in FIG. 12, and in an anchor closed configuration once fully and substantially firmly engaged therein, as illustrated in FIG. 13. The shell inlet 77 is delimited by an inlet peripheral surface 79 extending between the shell outer surface 15 and the chamber 13. The valve handle anchor 100 and the inlet peripheral surface 79 are thus configured and sized so that in the anchor closed configuration, the anchor outlet 63 abuts against the inlet peripheral surface 79, and in the anchor open configuration, the valve handle anchor 100 is partially inserted in the shell inlet 77 so that the anchor outlet 69 is spaced apart from the inlet peripheral surface 79 to allow flow of the inert gas out from the anchor outlet 63 into the shell inlet 77.

Although the assembled shell first and second portions 12 and 14 cooperatively form a substantially elongated and rounded ended burial capsule 10, it is to be understood that other general shape configurations and relative proportions are possible. For example, the assembled shell first and second portions 12 and 14 can cooperatively form a sealable burial capsule 10 having the general outer shape of a conventional burial coffin, a burial capsule having a general configuration and size suitably adapted for preserving the body of a dog, a cat or a horse or, in other instances, a specimen such as a reptile, or the like, for future science experiments.

Thus, as it would be obvious to someone in the art, a burial capsule 10 of the present invention may be advantageously produced having relatively high aesthetical characteristics of shape, design and color. For example, the burial capsule 10 may have a substantially elongated sleek design, as exemplified in the drawings, with high color finish achieved through an anodized color process applied to the various metal parts.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole. The present invention can thus be modified without departing from the spirit and nature of the subject invention as defined in the appended claims.

What is claimed is:

1. A burial capsule usable with an inert gas for replacing air in said burial capsule, said burial capsule comprising:

a sealable shell defining a chamber therein and a shell outer surface, said shell defining a shell inlet and a shell outlet both extending therethrough between said shell outer surface and said chamber for respectively receiving said inert gas and releasing said air contained in said chamber to allow replacement of said air by said inert gas when said inert gas flows in said chamber through said shell inlet;

a first valve handle anchor mounted to said shell; and a first handle mounted to said first valve handle anchor;

wherein said first valve handle anchor defines a first anchor inlet, a first anchor outlet and a first anchor passageway extending therebetween, said first valve handle anchor being configurable between a first anchor open configuration and a first anchor closed configuration, wherein, in said first anchor open configuration, said first anchor outlet is in a fluid communication relationship with said shell inlet and flow of said inert gas through said first anchor passageway from said first anchor inlet to said first anchor outlet is allowed, and, in said first anchor closed configuration, flow of said inert gas between said first anchor inlet and said shell inlet is prevented.

2. A burial capsule as defined in claim 1, wherein said shell includes a shell first portion and a shell second portion, said shell first and second portions being joined to each other by a shell first portion-to-shell second portion joint.

3. A burial capsule as defined in claim 2, wherein said first valve handle anchor is removably mounted to said shell.

4. A burial capsule as defined in claim 3, wherein said first valve handle anchor is removably mounted to said shell at said shell first portion-to-shell second portion joint so that when said first valve handle anchor is mounted to said shell, said first valve handle anchor engages both said shell first and second portions to lock said shell first and second portions to each other.

5. A burial capsule as defined in claim 4, wherein said shell first portion-to-shell second portion joint is a tongue and groove joint, said shell inlet extending through said tongue and groove joint and said first valve handle anchor being mounted to said shell inlet.

6. A burial capsule as defined in claim 5, further comprising a second valve handle anchor removably mounted to said shell, said shell outlet extending through said tongue and groove joint and said second valve handle anchor being mounted to said shell outlet.

7. A burial capsule as defined in claim 6, wherein said second valve handle anchor defines a second anchor inlet, a second anchor outlet and a second anchor passageway extending therebetween, said second valve handle anchor being configurable between a second anchor open configuration and a second anchor closed configuration, wherein, in said second anchor open configuration, said second anchor inlet is in a fluid communication relationship with said shell outlet and flow of said air through said second anchor passageway from said second anchor inlet to said second anchor outlet is allowed, and, in said second anchor closed configuration, flow of said air between said shell outlet and said second anchor outlet is prevented.

8. A burial capsule as defined in claim 5, wherein said shell inlet is delimited by an inlet peripheral surface extending between said shell outer surface and said chamber, said first valve handle anchor and said inlet peripheral surface being configured and sized so that in said first anchor closed configuration, said first anchor outlet abuts against said inlet peripheral surface, and in said first anchor open configuration, said first valve handle anchor is partially inserted in said shell inlet so that said first anchor outlet is spaced apart from said inlet peripheral surface to allow flow of said inert gas out from said first anchor outlet into said shell inlet.

9. A burial capsule as defined in claim 1, wherein said first valve handle anchor includes a valve operatively coupled to said first anchor passageway so that said valve is configurable between a valve open configuration and a valve closed configuration respectively allowing and preventing flow of said inert gas through said first anchor passageway, said valve being in said valve open and closed configurations when said first valve handle anchor is respectively in said first anchor open and closed configurations.

10. A burial capsule as defined in claim 1, wherein said first valve handle anchor is substantially elongated, said first anchor passageway extending substantially longitudinally through said first valve handle anchor.

11. A burial capsule as defined in claim 1, wherein said shell defines a fluid collecting basin, said burial capsule further comprising a substantially rigid and fluid permeable body support substantially adjacent said fluid collecting basin.

12. A burial capsule as defined in claim 11, wherein said body support is selected from the group consisting of a perforated metal sheet and a metal screen filter.

13. A burial capsule as defined in claim 11, further comprising cat litter provided in said fluid collecting basin.

14. A burial capsule as defined in claim 1, further comprising at least one wheel protruding from said shell.

15. A burial capsule as defined in claim 14, wherein said wheel is a spherical wheel partially contained in said shell.

16. A burial capsule as defined in claim 1, wherein said first anchor inlet and outlet are hidden from view respectively by said first handle and said shell when said first valve handle anchor is mounted to said shell and said first handle is mounted to said first valve handle anchor.

* * * * *